US006412929B1

(12) United States Patent
Chen

(10) Patent No.: US 6,412,929 B1
(45) Date of Patent: Jul. 2, 2002

(54) APPARATUS FOR SUPPLYING FLUID TO AN INK JET NOZZLE

(75) Inventor: Chin-Tai Chen, Kaohsiung (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/361,109

(22) Filed: Jul. 26, 1999

(51) Int. Cl.[7] ..... B41J 2/175
(52) U.S. Cl. ..... 347/86
(58) Field of Search ..... 347/85, 86, 87, 347/89, 84, 7; 222/158, 377, 321.5, 464.7

(56) References Cited

U.S. PATENT DOCUMENTS

| | | | | | |
|---|---|---|---|---|---|
| 4,470,526 | A | * | 9/1984 | Cha et al. | 222/320 |
| 4,580,147 | A | * | 4/1986 | DeYoung et al. | 347/88 |
| 4,831,389 | A | | 5/1989 | Chan | 347/86 |
| 5,469,201 | A | * | 11/1995 | Erickson et al. | 347/85 |
| 5,686,947 | A | | 11/1997 | Murray et al. | 347/85 |
| 5,745,137 | A | | 4/1998 | Scheffelin et al. | 347/85 |
| 5,757,406 | A | | 5/1998 | Kaplinsky et al. | 347/87 |
| 5,777,634 | A | * | 7/1998 | Okamura et al. | 347/7 |
| 6,155,679 | A | * | 12/2000 | Sato | 347/92 |
| 6,223,131 | B1 | * | 4/2001 | Kanaya et al. | 702/55 |

FOREIGN PATENT DOCUMENTS

| | | | |
|---|---|---|---|
| JP | 10-086395 | * | 4/1998 |

* cited by examiner

*Primary Examiner*—Michael Nghiem
(74) *Attorney, Agent, or Firm*—Knobbe, Martens, Olson & Bear, LLP

(57) ABSTRACT

The present invention relates to a cartridge for supplying fluid to an ink jet nozzle. The fluid or ink level of the cartridge is indicated by a visualization through a transparent plate and has a scale to facilitate the determination of remaining ink in the cartridge. The cartridge additionally possesses features which allow ink to be guided and collected into a recess thereby reducing the amount of residual ink which remains in a cartridge.

18 Claims, 5 Drawing Sheets

APPARATUS FOR SUPPLYING FLUID TO AN INK JET NOZZLE

BACKGROUND OF THE INVENTION

1. Field of the Invention

This invention relates to an apparatus for supplying fluid to an ink jet nozzle. In particular, this invention relates to a tall, narrow, rectangular cartridge formed with a recess in the inner base so as to eliminate residual ink left therein.

2. Description of Prior Art

"Ink-jet printer with user replaceable printing system cartridge", disclosed in U.S. Pat. No. 4,831,389, provides a rigid ink container supplying ink to the nozzle. Owing to the geometrical structure of the ink container, the ink cannot be entirely transmitted to the nozzle. thus, a volume of the ink is left as residue. Erickson et al discloses a trapezoidal ink container to eliminate the residual ink left therein. However, it is not easy to remove the trapezoidal container from the printer. Although a flat ridge cartridge with lunate structure, disclosed in "Ink jet printer incorporating high volume reservoirs", U.S. Pat. No. 5,686,947, can eliminate the residual ink, the replacement of the cartridge is inconvenient and the user cannot determine the actual volume of ink left in the cartridge at a given moment. "Continuous Refill of spring bag reservoir in an ink jet swath printer/plotter" disclosed in U.S. Pat. No. 5,745,137 and "Negative pressure ink delivery system" disclosed in U.S. Pat. No. 5,757,406, respectively provide a flat and flexible ink bag to store the ink. However, the user also cannot tell the actual volume of ink left in the flexible bag from the outside.

SUMMARY OF THE INVENTION

To solve the above problem, the primary object of this invention is to provide a cartridge for supplying ink to a jet nozzle and leaving minimum residual ink therein. The present invention comprises a reservoir with a tall, narrow, rectangular structure for storing the ink and a transmitting device having a duct disposed in the reservoir so as to transmit the ink to the ink jet. A transparent panel disposed on the reservoir is used to indicate the volume of the ink left therein. The tall-narrow rectangular reservoir has an inner base that is composed of a primary surface and a secondary surface. In comparison with the level ink, the secondary surface is lower than the primary surface. Therefore, the residual ink left on the primary surface can be gathered and guided to the secondary surface.

The present invention is characterized in that a recess (rectangular, trapezoidal, triangular, or a semi-spherical) with a secondary surface is formed next to the primary surface, and the opening of the duct is disposed in the recess. The residual ink left on the primary surface can therefore be finally gathered and guided into the recess.

BRIEF DESCRIPTION OF THE DRAWINGS

The present invention can be more fully understood by reading the subsequent detailed description and examples with reference made to accompanying drawings in which:

FIGS. 4A, 4B, 4C are three perspective diagrams respectively showing three types of recesses formed on the bottom of a cartridge, wherein:

FIG. 4A shows a trapezoidal recess;

FIG. 4B shows a triangular recess; and

FIG. 4C shows a semi-spherical recess.

DETAILED DESCRIPTION OF THE PREFERRED EMBODIMENTS

Figure 1:
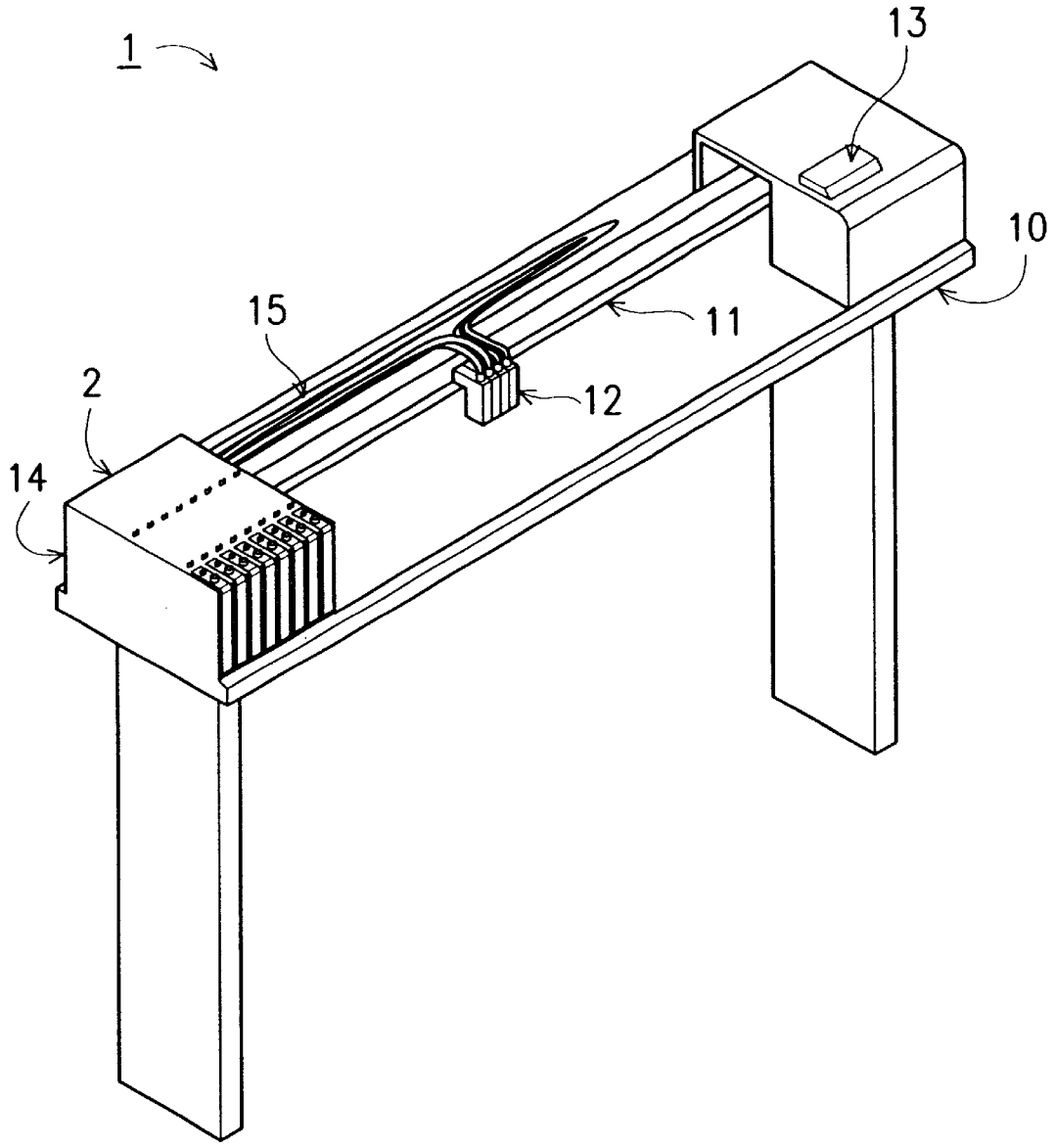
FIG. 1 is a perspective diagram showing the structure of a plotter.

Referring to FIG. 1, a perspective diagram shows the structure of a plotter 1. The plotter 1 comprises a frame structure 10, a guiding bar 11 mounted on the frame structure 10, a set of ink jet heads 12 reciprocally movable along the bar 11, a control device 13 installed on the frame structure 10 and a seat 14 for receiving an ink source 2. The ink source 2 is a replaceable element communicated with each ink jet 10 with a flexible tube 15 and used to supply the ink to the ink jet heads 10. The control device 13 controls the movement of the ink jet 10 and the flow rate of the ink outputted from the ink source 2.

Figure 2A:
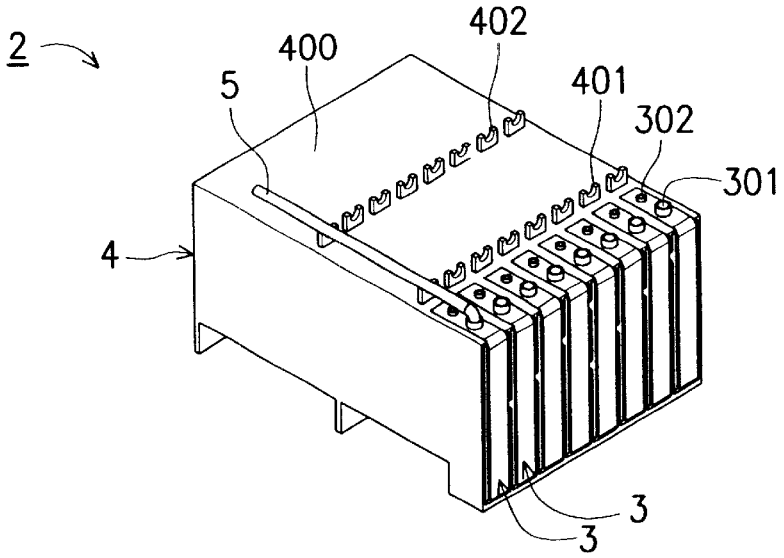
FIG. 2A is a perspective diagram showing the structure of a set of cartridges received together in a case according to the present invention.
Figure 2B:
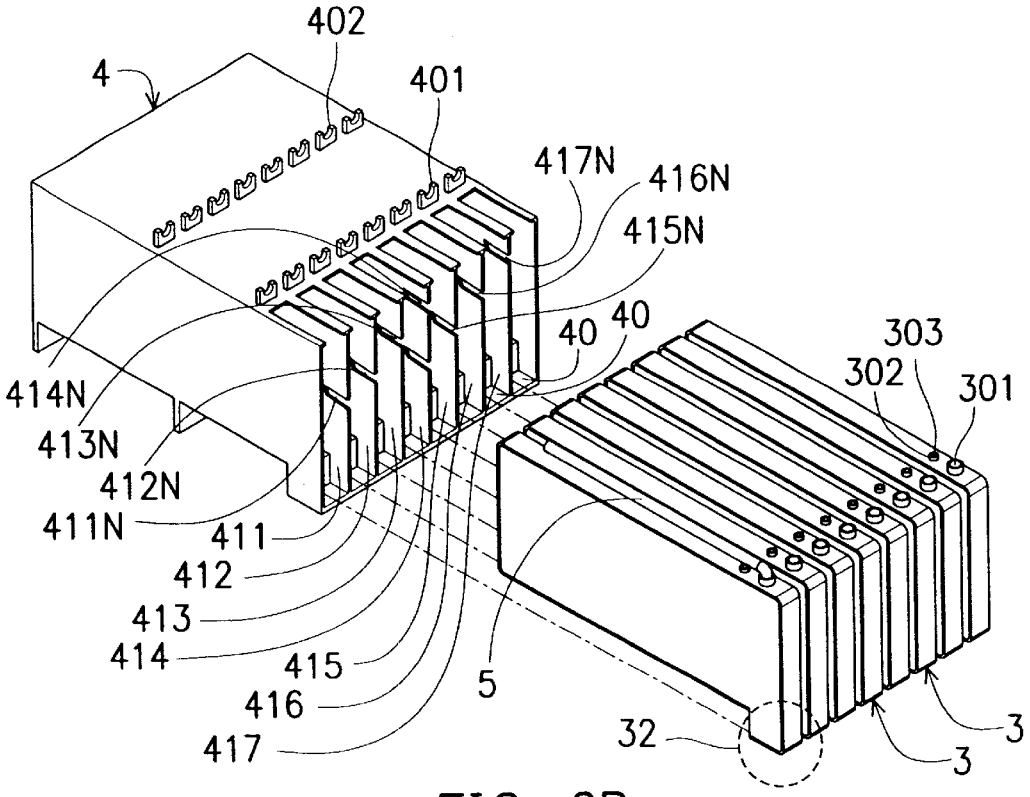
FIG. 2B is an exploded perspective diagram showing the structure of the cartridges and the case according to FIG. 2A.

FIG. 2A is a perspective diagram showing the assembly structure of the ink source 2 and FIG. 2B is an exploded view according to FIG. 2A.

Referring to FIG. 2B, the ink source 2 comprises a set of cartridges 3 spaced with each other and together received in a case 4. Each cartridge 3 is provided with two openings 301, 302 used to be an entrance for a duct 5 and a vent (sealed by a plug 303), respectively.

Figure 3A:
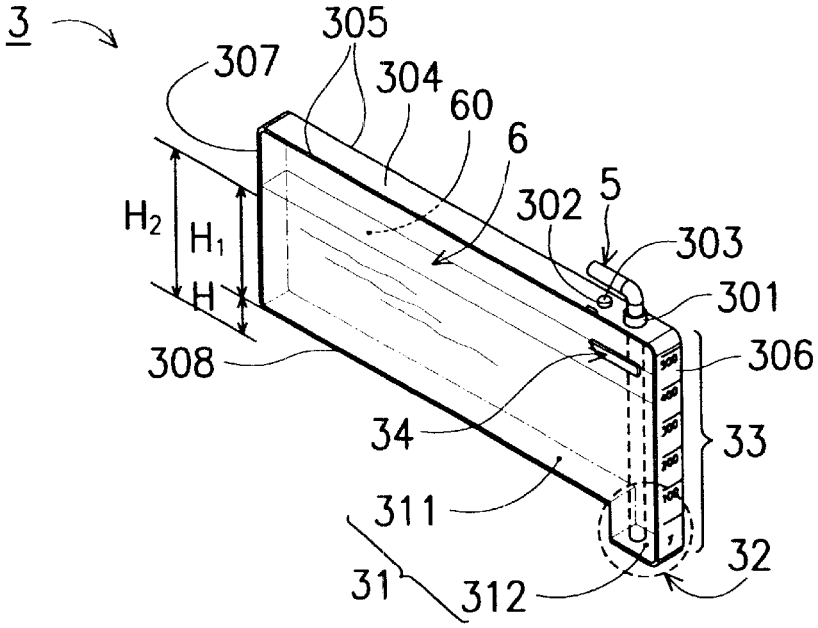
FIG. 3A is a perspective diagram showing the structure of the cartridge of the present invention.

The case 4 is formed with several longitudinal slots 40 spaced apart from each other by division plates 411, 412, 413, 414, 415, 416, 417 and used to receive cartridges 20, respectively. Pairs of spaced clamps 401, 402 are formed on the top surface 400 of the case 4 in alignment with the slots 40, and each pair of clamps 401, 402 is used to clamp the duct 5. Notches 411N, 412N, 413N, 414N, 415N, 416N, 417N are respectively formed on the end portion of each of the plates 411–417, and any two of these notches 411N–417N are asymmetrical to each other. Each cartridge 3 is provided with a protrusion 34 formed on the sidewall of the cartridge 3 (as shown in FIG. 3A). When placed in the destined slot 40, the cartridge 3 fits into only one of the notches 411N–417N. This is a so-called "idiot-proof design" applied on the present invention so as to prevent the destined cartridge 3 from being placed in the wrong slot 40.

Figure 3B:
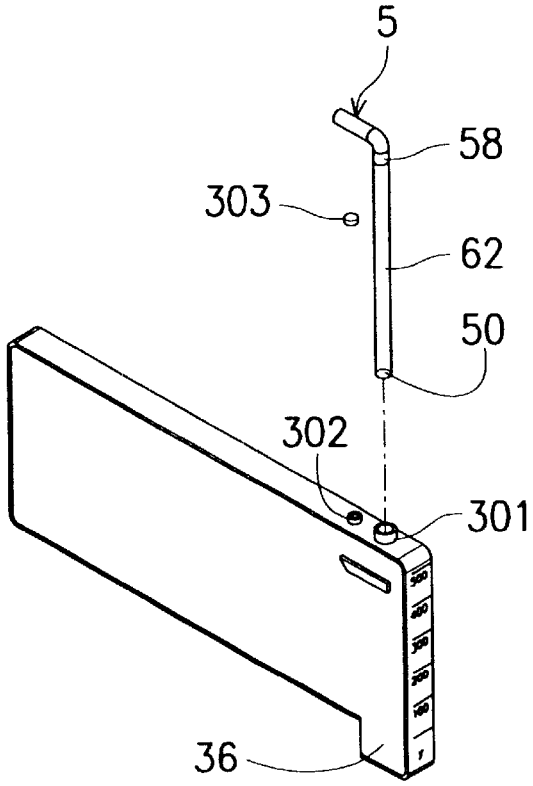
FIG. 3B is an exploded perspective diagram showing a duct separated from the cartridge.

Referring to FIG. 3A and FIG. 3B, FIG. 3A is a perspective diagram showing the structure of the cartridge 3 and FIG. 3B is an exploded view showing the duct 5 separated from the cartridge 3.

The cartridge 3 has a container 30 serving as a reservoir to store the ink 6, and the duct 5 extended into the container 30 is merged in the ink 6. The container 30, formed in a shape of tall, narrow, rectangular structure, comprises a top plate 304, two side plates 305, a front plate 306, a rear plate 307 and a bottom plate 308. The openings 301, 302 are formed on the top plate 304 and the protrusion 34 is formed on one side plate 305, and a scale 33 with numbers is noted on the front plate 305 according the inner volume of the container 30. The front plate 306 is a transparent plate made of acryl resin or other transparent material, so that the user can tell outside the volume of the ink 6 stored in the container 30. In addition, the container 30 has an inner base 31 composed of a primary surface 311 and a secondary surface 312. The primary surface 311 and the secondary surface 312 are next to each other with a height difference H, i.e. the primary surface 311 has a depth $H_2$ and the secondary surface 312 has a depth $H_2$ with respect to the level 60 of the ink 6. In other words, a rectangular recess 32 is formed in the inner base 31 next to the primary surface 311, and the secondary surface 312 is the bottom of the rectangular recess 32. The opening 50 of the duct 5 is disposed facing on the secondary surface 312.

The duct 5 drains the ink 6 out off the cartridge 3. When the ink level 60 first reaches the primary surface 311, part of ink 6 still remains on the primary surface 311. When the ink level 60 is about to be lower than the primary surface 311, the residual ink left on the primary surface 311 is induced to and accumulated in the recess 32 by its cohesive force. Finally, the ink 6 gathered in the recess 32 can be sucked up by the duct 5.

Figure 4A:
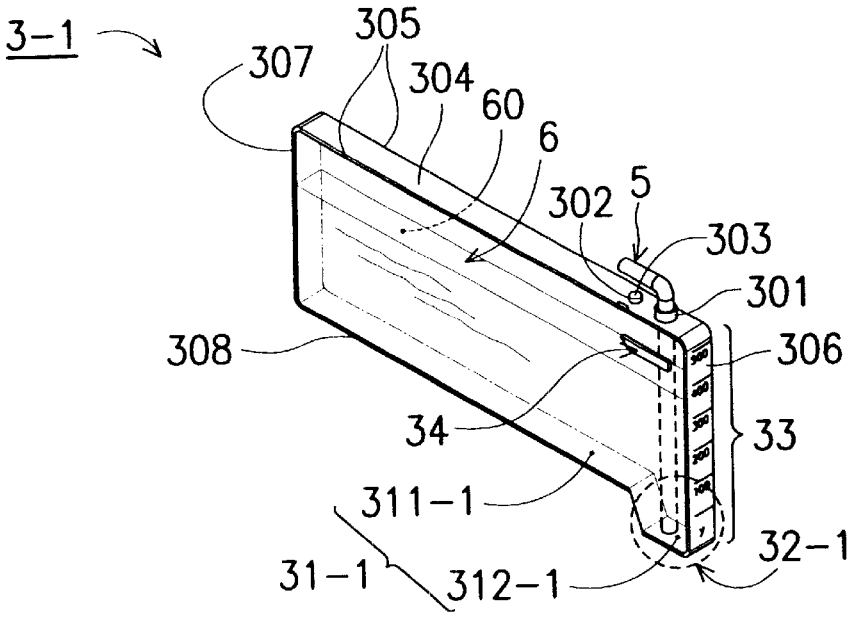
Figure 4B:
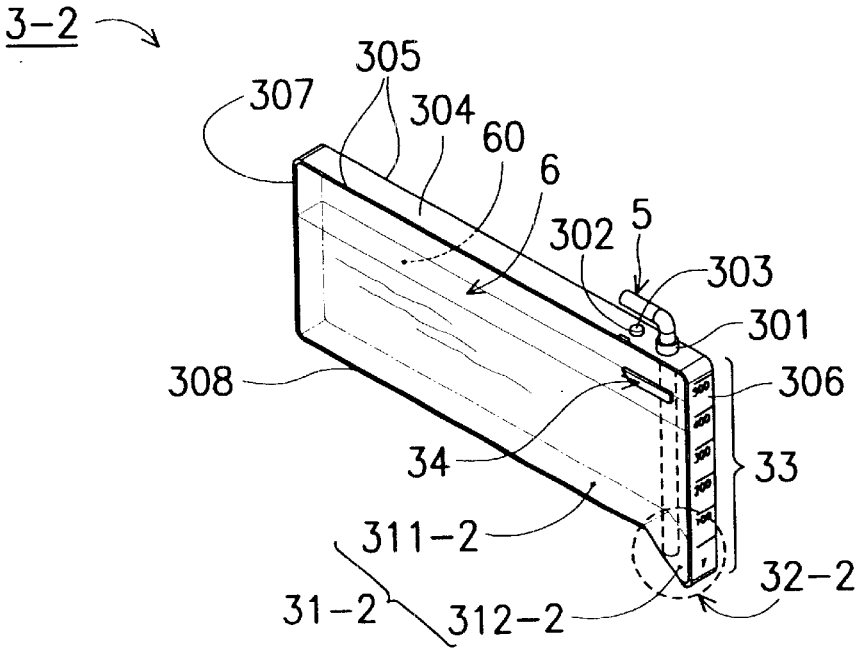
Figure 4C:
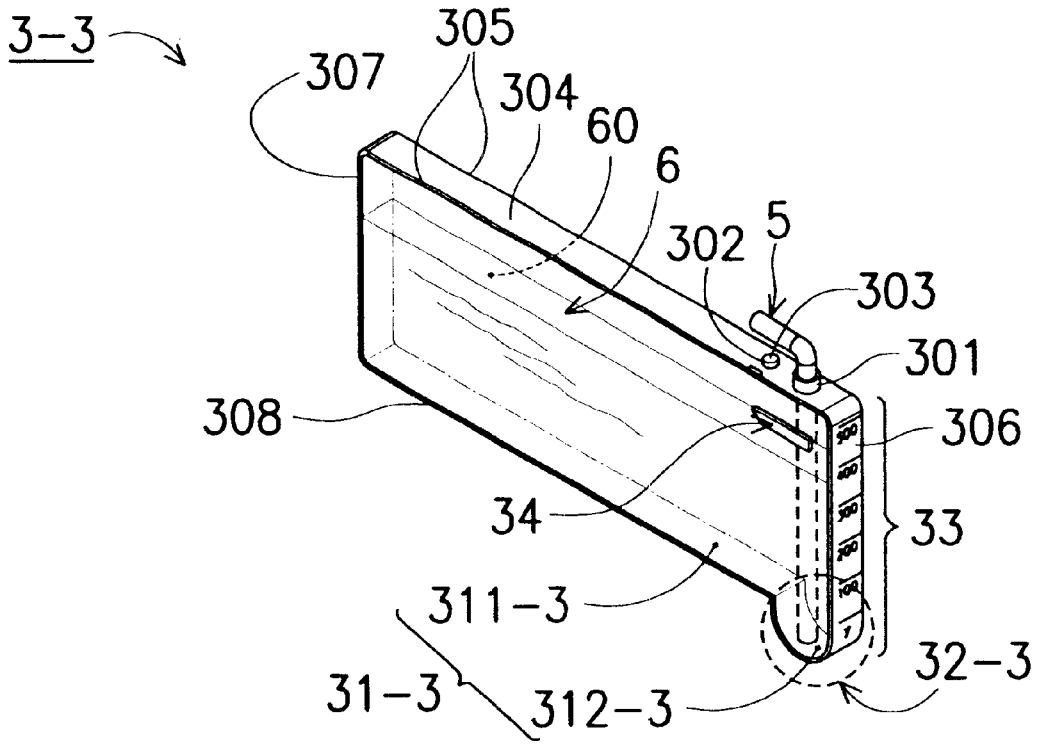

FIGS. 4A, 4B, 4C are three perspective diagrams showing three types of recesses 32-1, 32-2, 32-3 formed on each bottom of the three cartridges 3-1, 3-2, 3-3, respectively. As mentioned above, the recess 32 is rectangular (or cylindrical) having the secondary surface 322 below the primary surface 311. The recess 32-1 is trapezoidal having an inner surface 312-1 below the primary surface 311. The recess 32-2 is triangular having a slanted surface 312-2 below the primary surface 311. The recess 32-3 is semi-spherical having an inner surface 312-3 below the primary surface 311. Each duct 5 disposed in the cartridges 3-1, 3-2, 3-3 can easily drain the ink 6 to the jet nozzle 12 from the recesses 32, 32-1, 32-2, 32-3, and the residual ink left on the primary surface 311 can completely and naturally flow to the recesses.

By converting the inner volume of the container 30 into a series numbers noted on the transparent plate 306 (a narrow-tall side), the volume of the ink 6 above the primary surface 311 and the secondary surface 312 can be clearly shown outside and indicated by these number.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for supplying fluid to an ink jet device, comprising:

a reservoir with a tall, narrow, rectangular structure for storing said fluid, having an inner base composed of a primary surface, an interconnecting surface, and a secondary surface next to and lower than the primary surface with said interconnecting surface being interposed between said primary and secondary surfaces and the secondary surface being a slant surface extending from the interconnecting surface, wherein as fluid is supplied to said ink jet device said fluid remaining on the primary surface is accumulated in a recess defining a volume bounded by the secondary surface and the interconnecting surface; and a panel having a scale disposed on said reservoir said scale being calibrated so as to correspond to the inner volume of said reservoir to thereby indicate the volume of said fluid left therein; and means for draining said fluid from said reservoir to said ink jet device, having a duct with an opening disposed within the volume bounded by the secondary surface and the interconnecting surface so as to suck up said fluid.

2. The apparatus as claimed in claim 1 further comprising said panel disposed on the sidewall of the reservoir to indicate the volume of said fluid left therein.

3. The apparatus as claimed in claim 2, wherein said ink jet device is an ink jet nozzle of a plotter, and said fluid is ink.

4. The apparatus as claimed in claim 1, wherein said recess is a rectangular recess.

5. The apparatus as claimed in claim 1, wherein said recess is a trapezoidal recess.

6. The apparatus as claimed in claim 1, wherein said recess is a semi-spherical recess.

7. An apparatus for supplying fluid to an ink jet nozzle of a plotter, comprising:

a reservoir with a tall, narrow, rectangular structure for storing said fluid, having an inner base composed of a primary surface and a secondary surface next to and lower than the primary surface forming a recess so as to accumulate said fluid remaining on the primary surface to the secondary surface;

a panel having a scale disposed on said reservoir said scale being calibrated so as to correspond to the inner volume of said reservoir to thereby indicate the volume of said fluid left therein; and means for draining said fluid from said reservoir to said ink jet nozzle, having a duct with an opening disposed on the secondary surface to suck up said fluid.

8. The apparatus as claimed in claim 7, wherein said panel is a transparent plate.

9. The apparatus as claimed in claim 8, wherein said fluid is ink.

10. The apparatus as claimed in claim 9, wherein the secondary surface is a slant surface extended from the primary surface.

11. The apparatus as claimed in claim 10, wherein said recess is a rectangular recess.

12. The apparatus as claimed in claim 10, wherein said recess is a trapezoidal recess.

13. The apparatus as claimed in claim 10, wherein said recess is a semi-spherical recess.

14. An apparatus for supplying fluid to an ink jet device, comprising:

a reservoir with a tall, narrow, rectangular structure for storing said fluid, having an inner base composed of a primary surface, an interconnecting ridge and a secondary surface next to and lower than the primary surface with said interconnecting ridge being intersected between said primary surface and said secondary surface and the secondary surface being a slant surface extending from the interconnecting ridge, wherein as fluid is supplied to said ink jet device said fluid remaining on the primary surface is accumulated in a recess defining a volume bounded by the secondary surface; and a panel having a scale disposed on said reservoir said scale being calibrated so as to correspond to the inner volume of said reservoir to thereby indicate the volume of said fluid left therein; and means for draining said fluid from said reservoir to said ink jet device, having a duct with an opening disposed within the volume bounded by the secondary surface and the interconnecting ridge so as to suck up said fluid.

15. The apparatus as claimed in claim 14 further comprising said panel disposed on the sidewall of the reservoir to indicate the volume of said fluid left therein.

16. The apparatus as claimed in claim 14, wherein said ink jet device is an ink jet nozzle of a plotter, and said fluid is ink.

17. The apparatus as claimed in claim 14, wherein said recess is a triangular recess.

18. The apparatus as claimed in claim 14, wherein said recess is a semi-spherical recess.

* * * * *